United States Patent [19]

Fleming

[11] Patent Number: 4,929,344

[45] Date of Patent: May 29, 1990

[54] METALS RECOVERY BY FLOTATION

[75] Inventor: Shane D. Fleming, Montville, N.J.

[73] Assignee: American Cyanamid, Stamford, Conn.

[21] Appl. No.: 345,749

[22] Filed: May 1, 1989

[51] Int. Cl.[5] ..... B03D 1/02

[52] U.S. Cl. ..... 209/166; 252/61

[58] Field of Search ..... 209/166, 167; 423/26; 75/2; 252/61

[56] References Cited

U.S. PATENT DOCUMENTS

| | | | |
|---|---|---|---|
| 2,919,025 | 12/1959 | Booth | 209/166 |
| 3,317,040 | 5/1967 | Booth | 209/166 |
| 4,661,278 | 4/1987 | Nagaraj | 209/166 |
| 4,684,459 | 8/1987 | Klimpel | 209/166 |
| 4,702,822 | 10/1987 | Klimpel | 209/166 |
| 4,822,483 | 4/1989 | Klimpel | 209/166 |

OTHER PUBLICATIONS

16 International Minerals Processing Congress, Stockholm, Sweden, Jun. 5–10, 1988—Nagaraj et al.

2nd International Mineral Processing Symposium Izmir, Turkey, Oct. 4–6, 1988.

Presented to the CIM, Sep. 1987, New Brunswick, N.J., "Developments of New Sulfide and Precious Metal Collectors" by Nagaraj et al.

*Primary Examiner*—Kenneth M. Schor

*Assistant Examiner*—Thomas M. Lithgow

*Attorney, Agent, or Firm*—Frank M. Van Riet

[57] ABSTRACT

Collector compositions for use in froth flotation processes for the beneficiation of gold, silver and platinum group values from base metal ores are disclosed. The collector compositions comprises at least one monothiophosphate compound selected from compounds of the formula:

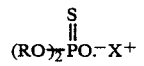

wherein each R is a $C_2$–$C_8$ alkyl or a

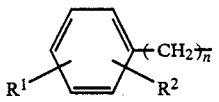

radical, $R^1$ and $R^2$ are, individually, hydrogen or $C_1$–$C_4$ alkyl radicals, n is 0 or 1 and X is a cation. The use of the monothiophosphate collectors provides excellent selective recovery of gold, silver and platinum group metal values in froth flotation processes conducted under alkaline conditions.

11 Claims, No Drawings

METALS RECOVERY BY FLOTATION

BACKGROUND OF THE INVENTION

The present invention relates to froth flotation processes for recovery of gold, silver and platinum group values from base metal ores. More particularly, it relates to improved collectors comprising certain monothiophosphate compounds which exhibit an excellent selective recovery of gold, silver and platinum group metals under alkaline conditions.

Froth flotation is one of the most widely used processes for beneficiating ores containing valuable minerals and is described in U.S. Pat. No. 4,584,097, hereby incorporated herein by reference.

The success of a flotation process depends to a great degree on the reagent(s) called collector(s) that impart(s) selective hydrophobicity to the valuable mineral that has to be separated from other minerals. Thus, the flotation separation of one mineral species from another depends upon the relative wettability of mineral surfaces by water. Typically, the surface free energy is purportedly lowered by the adsorption of heteropolar collectors. The hydrophobic coating thus provided acts, in this explanation, as a bridge so that the mineral particles may be attached to an air bubble. The practice of this invention is not, however, limited by this or other theories of flotation.

Xanthates, dithiophosphates, alkyl xanthogen alkyl formates, bis alkyl xanthogen formates, dialkylthionocarbamates, hydrocarboxycarbonyl thionocarbamates, etc. have been shown to be useful collectors in froth flotation processes. Most of these known collectors, however, are known to suffer from at least one deficiency which prevents them from being used universally for the recovery of metals from each and every ore requiring refining, such as pH dependency, affinity for some metals versus others etc.

The use of monothio phosphinates as collectors for the recovery of copper is taught in U.S. Pat. Nos. 4,587,013 and 4,661,278. The recovery of gold from gold containing tailings or primary gold ores with dicresyl monothiophosphate is disclosed in Nagaraj et al; XVI International Minerals Processing Congress, Stockholm, Sweden, June 5–10, 1988; Edited by E. Forssberg; Elsevier Science Publishers B. V. Amsterdam; Nagaraj et al; Proceedings of the II International Mineral Processing Symposium; Izmir, Turkey; Oct. 4–6, 1988; Dokuz Eylul University; Dept. of Mining Eng.; Bornova. Nagaraj et al, Development of New Sulfide and Precious Metals Collectors, Presentation at the CIM; Sept. 1987, New Brunswick, N.J. Additionally, U.S. Pat. Nos. 2,919,025 and 3,317,040 disclose the recovery of copper from copper ores utilizing monothiophosphates under alkaline conditions. None of these publications, however, disclose the recovery of gold with said monothiophosphates selectively from other metals at alkaline pH. In sulfide flotation, Nagaraj, et. al., above, stated that the optimum pH is 3 to 7 for the monothiophosphate based collectors. It is therefore entirely unexpected that monothiophosphates, in precious metal flotation, were found to exhibit such a high degree of selectivity for precious metals and against base metal sulfide minerals such as copper minerals and pyrite above acidic pH values. Furthermore, selectivity for precious metals is very pH specific, as illustrated by examples below. Thus, even though monothiophosphates were known as collectors for sulfide minerals under acidic conditions, those skilled in the art did not and could not have predicted the unique features of this invention.

Accordingly, it is an object of the present invention to provide an improved collector and flotation process for the beneficiation of minerals employing froth flotation methods for the selective recovery of gold, silver and platinum group metals from ore.

SUMMARY OF THE INVENTION

In accordance with the present invention, there is provided a new and improved process for beneficiating gold, silver and platinum group metal containing ores with selective rejection of other metals such as copper and iron, said process comprising: grinding said ore to provide particles of flotation size, slurrying said particles in an aqueous medium, conditioning said slurry with effective amounts of a frothing agent and a metal collector, frothing the desired minerals preferentially over gangue minerals by froth flotation procedures at a pH over about 7.0; said metal collector comprising at least one monothiophosphate compound selected from compounds having the formula:

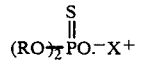

wherein each R is, individually selected from $C_2$–$C_8$ alkyl radicals and

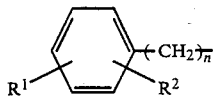

radicals wherein $R^1$ and $R^2$ are, individually, hydrogen or $C_1$–$C_4$ alkyl radicals, n is 0 or 1 and X is a cation.

The monothiophosphate collectors and the process of the present invention unexpectedly provided superior selective gold, silver and platinum group metals recovery in froth flotation separations as compared with many conventional collectors, even at reduced collector dosages, under conditions of alkaline pH.

Other objects and advantages of the present invention will become apparent from the following detailed description and illustrative working examples.

DETAILED DESCRIPTION OF THE INVENTION

In accordance with the present invention, gold, silver and platinum group metal values are selectively recovered by froth flotation methods in the presence of a novel collector, said collector comprising at least one monothiophosphate compound of the above formula. The R radicals of the monothiophosphates may independently be selected from ethyl, propyl, n-butyl, t-butyl, isobutyl, n-hexyl, cyclohexyl, heptyl, octyl, 2,3 or 4-methylphenyl, phenyl, benzyl, 2,6-dimethyl phenyl, 2,6-diisobutyl benzyl groups and the like.

In preferred embodiments, the monothiophosphate collectors of the above formula employed are those compounds wherein each R is a

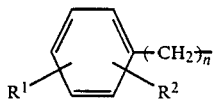

radical, and especially preferred are those monothiophosphates where n is 0, $R^1$ is hydrogen and $R^2$ is methyl.

Illustrative compounds within the above formula for use as collectors in accordance with the present invention include:

diethyl monothiophosphate,
di-t-butyl monothiophosphate,
diisobutyl monothiophosphate,
dioctyl monothiophosphate,
diphenyl monothiophosphate,
dibenzyl monothiophosphate,
dicresyl monothiophosphate,
bis(2,6-dimethylphenyl) monothiophosphate, and the like.

The monothiophosphates of the present invention may be conveniently prepared as described in U.S. Pat. No. 3,206,493, hereby incorporated herein by reference. Commercial grade acids which are used in the preparation of the monothiophosphates used herein usually contain a mixture of materials, e.g. cresylic acids usually contain a mixture of phenol, cresols, xylenols and high alkyl phenols, and the phosphates made therefrom often therefore also contain a complex mixture of products. Such products are contemplated for use herein and it is understood that mention herein of any specific monothiophosphate includes such commercially available complex mixtures thereof which result during manufacture.

In accordance with the present invention, the above-described monothiophosphates are employed as collectors in a new and improved froth flotation process which provides a method for enhanced selective beneficiation of gold, silver and platinum group values from ores under alkaline conditions.

In accordance with the present invention, the new and improved process for the selective beneficiation of gold, silver and platinum group values from base metal ores comprises, firstly, the step of size-reducing the ore to provide ore particles of flotation size. Generally, and without limitation, suitable particle size will vary from between about 5 microns to about 300 microns. Preferably, the ore will be size-reduced to provide flotation sized particles of between about 30 microns to about 200 microns. Especially preferable for use in the present method are base metal ores which have been size-reduced to provide from about 14% to about 30%, by weight, of particles of +75 microns and from about 40% to about 90%, by weight, of particles of −38 microns.

Size reduction of the ores may be performed in accordance with any method known to those skilled in this art.

Preadjustment of pH is conveniently performed by addition of the pH modifier to the grind during the size reduction step.

The pH of the pulp slurry may be preadjusted to any desired value by the addition of lime etc. Thus, for example, excellent selective beneficiation has been obtained in accordance with the process of the present invention at pH values of over 7.0 to about 12.0, preferably from about 8.0 to about 11.0.

The size-reduced ore, e.g., comprising particles of liberation size, is thereafter slurried in aqueous medium to provide a floatable pulp. The aqueous slurry or pulp of flotation sized ore particles, typically in a flotation apparatus, is adjusted to provide a pulp slurry which contains from about 10 to 60%, by weight, of pulp solids, preferably 25 to 50%, by weight, and especially preferably from about 30% to about 40%, by weight, of pulp solids.

In accordance with a preferred embodiment of the process of the present invention, the flotation of gold, silver and platinum group metals is performed at a pH of from about 8.5 to about 10.0. It has been discovered that in conducting flotation at this pH range, the collectors of the present invention exhibit exceptionally high collector strength, together with excellent collector selectivity, even at reduced collector dosages.

After the pulp slurry has been prepared, the slurry is conditioned by adding effective amounts of a frothing agent and a collector comprising at least one monothiophosphate compound as described above. By "effective amount" is meant any amount of the respective components which provides a desired level of beneficiation of the desired metal values. Generally, about 0.005 to about 0.5 lb. of collector per ton of ore is sufficient.

Any known frothing agent may be employed in the process of the present invention. By way of illustration, such frothing agents as straight or branched chain low molecular weight hydrocarbon alcohols, such as $C_6$ to $C_8$ alkanols, 2-ethyl hexanol and 4-methyl-2-pentanol, also known as methyl isobutyl carbinol (MIBC) may be employed, as well as pine oils, cresylic acid, polyglycol or monoethers of polyglycols and alcohol ethoxylates, to name but a few. Generally, and without limitation, the frothing agent(s) will be added in conventional amounts and amounts of from about 0.01 to about 0.2 pound of frothing agent per ton of ore treated, are suitable.

Thereafter, the conditioned slurry, containing an effective amount of frothing agent and an effective amount of collector, is subjected to a frothing step in accordance with conventional froth flotation methods to float the desired gold, silver and/or platinum group metal values in the froth concentrate and selectively reject or depress other metal values such as copper, iron, etc.

The improved collectors of the present invention may be added to the flotation cell as well as to the grind.

The collectors of the present invention have been described for use in those applications wherein it is desired to selectively concentrate or collect certain gold, silver and/or platinum group value metals from gangue materials, e.g., silicates, copper, iron, carbonates, oxides, etc.

The collectors of the present invention may be used alone or in conjunction with such auxiliary collectors as xanthates, dithiophosphates, dithiophosphinates, thioureas, mercaptobenzothiazoles, and the like, in amounts up to about 60.0%, by weight, based on the total weight of the monothiophosphate represented in the formula above, preferably up to about 40%, by weight, same basis.

The following examples are set forth for purposes of illustration only and are not to be construed as limiting the instant invention except as set forth in the appended claims. All parts and percentages are by weight unless otherwise specified. The ores are processed as follows:

A one kilogram charge of ore is ground in a ball mill, at 60% solids, with about 200 g/ton of sodium carbonate, to produce a pulp having a size such that 70% passes a 200 mesh screen.

The ground pulp is transferred to a flotation cell and diluted to 27% solids, by mass.

The resultant slurry is conditioned with collector and frother (MIBC) for 2 minutes and floated for 10 minutes, at an air flow rate of 5 liters/minute.

A second stage conditioning and flotation are carried out for 2 minutes and 9 minutes, respectively, at the same air flow.

EXAMPLE 1

A western U.S. gold ore having a head assay of 0.128 oz./ton of gold and 0.16% sulfur (pyritic) is floated at a pH of 8.5 using dicresyl monothiophosphate (Collector A) and dicresyl dithiophosphate (Comparative Collector B), each in conjunction with an auxiliary collector, potassium amyl xanthate (PAX). The PAX is added to the flotation cell and the collectors are added to the grind. The results are set forth in Table I, below.

TABLE I

| | | | Concentrate | | |
|---|---|---|---|---|---|
| Test | Collector | lb/ton | Gold Grade | Gold Recovery | S Recovery |
| 1 | A | 0.056 | 2.382 | 94.0% | 89.6% |
| | PAX | 0.050 | | | |
| 2 | B | 0.056 | 0.92 | 90.2% | 92.6% |
| | PAX | 0.050 | | | |

As can be seen, dicresyl monothiophosphate results in a higher grade of gold, higher gold recovery and lower sulfur content in the flotation product.

EXAMPLE 2

A gold ore having a head assay of 0.045 oz/ton of gold and 1.73% sulfur is floated at pH 8.9 as in Example 1. The results are set forth in Table II, below.

TABLE II

| | | | CONCENTRATE | | |
|---|---|---|---|---|---|
| | | | | Recovery | |
| Test | Collector | lb/ton | Gold Grade | Gold | Sulfur |
| 1 | A | 0.071 | 0.318 | 91.8 | 79.6 |
| | PAX | 0.020 | | | |
| 2 | B | 0.071 | 0.307 | 90.2 | 92.1 |
| | PAX | 0.020 | | | |

Thus, both collectors give similar gold grade and recovery, but the pyrite sulfur recovery is 12.5% lower for the dicresyl monothiophosphate showing its selectivity against pyrite.

EXAMPLE 3

Collectors A & B of Example 1 are utilized to float an oxide gold ore containing substantial amounts of free gold. Both collectors give an identical tailing gold assay of 0.004 oz./ton, but the concentrate grade obtained with Collector A is much higher than that with Collector B. Using only Collector A in the rougher flotation stage, 91.5% of the gold is recovered at only 1.1% sulfur recovery, the concentrate assaying 2.178 oz/ton gold. By comparing with Test 2 in Table III, it is thus evident that dicresyl monothiophosphate is exceptionally effective as a selective gold collector.

Utilizing Collector A and Collector B on the rod mill composite feed yields very similar results. Using only Collector A in the rougher stage, the gold recovery is 78.8% at a sulfur recovery of 8.6% and a concentrate assay of 1.031 oz/ton gold. The rod mill composite feed contains about 1% sulfur compared to about 0.2% sulfur for the oxide ore described above.

EXAMPLE 4

An ore having a head assay of 0.07 oz/ton gold and 1.47% sulfur is treated as above. The performance of Collector A is tested as a function of pH at a dosage of 0.07 lb/ton in the rougher float and 0.03 lb/ton of PAX in the scavenger. The results are set forth in Table III, below.

TABLE III

| | | Percent Gold Recovery | | Percent S Recovery | | Rougher Conc. Assay | |
|---|---|---|---|---|---|---|---|
| | | | | | | Gold | Sulphur |
| Test | pH | Rougher | Total | Rougher | Total | oz./ton | % |
| 1 | 4.0 | 84.7 | 90.1 | 98.1 | 99.6 | 0.542 | 18.9 |
| 2 | 5.0 | 76.4 | 90.0 | 57.2 | 99.6 | 0.704 | 13.0 |
| 3 | 6.0 | 56.1 | 92.2 | 1.2 | 97.2 | 1.248 | 0.467 |
| 4 | 7.0 | 75.8 | 90.4 | 1.5 | 90.1 | 1.344 | 0.526 |
| 5 | 8.0 | 75.0 | 92.6 | 2.1 | 99.0 | 1.012 | 0.676 |

The results show that the best flotation results for dicresyl monothiophosphate are above pH 7.0. At pH 4.0 and 5.0, the selectivity against pyrite diminishes as evidenced by the high sulfur content in the rougher concentrates whereas at 6.0 the percent gold recovery in the rougher is diminished.

EXAMPLE 5

The selectivity of dicresyl monothiophosphate towards gold is further demonstrated in the following table. A ten minute rougher stage flotation is carried out with the monothiophosphate only followed by a seven minute scavenger float with PAX. The rougher and scavenger concentrates are collected separately and assayed separately to best evaluate each test. The dosage rate of Collector A is the only variable in these tests. The rod mill feed composite used in these tests is a oxide/sulfide blend containing clays and talc. The results are set forth in Table IV, below.

TABLE IV

| | Dosage Rate | Precent Gold Recovery | | Percent S Recovery | | Rougher Conc. Assay | |
|---|---|---|---|---|---|---|---|
| | | | | | | Gold | Sulfur |
| Test | lb/ton | Rougher | Total | Rougher | Total | oz./ton | % |
| 1 | 0.13 | 80.1 | 91.2 | 3.0 | 97.6 | 0.310 | 0.489 |
| 2 | 0.10 | 79.6 | 91.2 | 2.9 | 97.2 | 0.400 | 0.433 |
| 3 | 0.071 | 57.3 | 92.4 | 2.5 | 97.0 | 0.254 | 0.410 |
| 4 | 0.049 | 65.9 | 89.5 | 2.1 | 95.7 | 0.302 | 0.392 |

The selectivity of dicresyl monothiophosphate is clearly shown by these results. There is also a good correlation between collector dosage rate and rougher gold and sulfur recovery. At dosage rates of 0.13 and 0.10 lb/ton, rougher gold recoveries are about 80% while rougher sulfur recoveries are only about 3%. The scavenge float with 0.03 lb/ton PAX activated pyrite, yields sulfur recoveries of 94% for each scavenger. As the dosage rate of the collector is lowered, the rougher grade and recovery for sulfur is also lowered.

EXAMPLE 6

The effect of varying the dosage of Collector A in the rougher is studied, with each test also employing a seven minute scavenger. PAX at 0.03 lb/ton is added prior to the scavenger. Rougher flotation is 10 minutes in duration. The example also includes a test employing Collector B as a rougher collector. The rod mill feed composite is a medium talcy sulfide ore. The metallurgical results are set forth in Table V, below.

TABLE V

| Test | Collector | Dosage Rate lb/ton | Percent Gold Recovery Rougher | Percent Gold Recovery Total | Percent S Recovery Rougher | Percent S Recovery Total | Au Rougher Concent. Oz/ton | Assay S % |
|---|---|---|---|---|---|---|---|---|
| 1 | A | 0.13 | 75.5 | 92.3 | 2.6 | 99.7 | 1.054 | 1.13 |
| 2 | A | 0.10 | 72.0 | 90.6 | 2.4 | 99.2 | 0.952 | 0.873 |
| 3 | A | 0.07 | 75.0 | 92.6 | 2.1 | 99.0 | 1.012 | 0.676 |
| 4 | A | 0.05 | 60.4 | 93.0 | 2.1 | 98.5 | 0.854 | 0.729 |
| 5 | B | 0.10 | 83.4 | 93.8 | 14.4 | 99.5 | 0.526 | 2.40 |

As recognized, usually recovery increases at the expense of grade. However, since dicresyl monothiophosphate is so selective, moderately higher feed rates do not promote any excess undesirable minerals.

EXAMPLE 7

An oxide/sulfide rod mill feed composite ore having a head assay of 0.034 oz/ton gold and 1.37% sulfur is floated as in Example 6 at a pH of 8.6. A test using a standard flotation technique of the gold industry (SMC) is included for comparison. The results shown in Table VI again indicate the excellent selectivity for gold against pyrite when using decresyl monothiophosphate versus Collector B.

TABLE VI

| Test | Collector | Dosage Rate lb/ton | Percent Gold Recovery Rougher | Percent Gold Recovery Total | Percent S Recovery Rougher | Percent S Recovery Total | Au Rougher Concent. Oz/ton | Assay S % |
|---|---|---|---|---|---|---|---|---|
| 1 | A | 0.13 | 77.3 | 90.9 | 1.4 | 91.7 | 0.210 | 0.146 |
| 2 | A | 0.10 | 79.0 | 90.9 | 1.3 | 81.4 | 0.212 | 0.124 |
| 3 | A | 0.07 | 78.0 | 90.0 | 0.9 | 66.1 | 0.268 | 0.108 |
| 4 | A | 0.05 | 71.5 | 86.9 | 0.8 | 52.0 | 0.194 | 0.101 |
| 5 | B | 0.10 | 78.3 | 88.5 | 10.4 | 98.8 | 0.184 | 0.978 |
| 6 | SMC | — | 83.9 | 92.8 | 98.3 | 99.6 | 0.164 | 8.26 |
| 7 | A | 0.10* | 73.0 | 86.0 | 1.8 | 3.0 | 0.186 | 0.171 |

*Collector A added to scavenger at 0.05 lb/ton - No PAX

EXAMPLES 8–15

Following the procedure of Example 1 except that a different pH is used, varius monothiophosphate collectors falling within the scope of this invention are tested as precious metal collectors on gold and other ores. The compositions and other variables are set forth in Table VII, below. Similar results are achieved.

TABLE VII

| Example | Collector R | Collector X | Primary Ore Metal | Auxillary Collector | pH |
|---|---|---|---|---|---|
| 8 | ethyl | Na | Au | MBT | 8.2 |

TABLE VII-continued

| Example | Collector R | Collector X | Primary Ore Metal | Auxillary Collector | pH |
|---|---|---|---|---|---|
| 9 | t-butyl | $NH_4$ | Pt/Pd | TU | 9.1 |
| 10 | phenyl | Na | Pt | none | 9.7 |
| 11 | i-butyl | Na | Au | none | 8.0 |
| 12 | n-octyl | Na | Au | DTP | 7.9 |
| 13 | benzyl | Na | Ag | none | 8.8 |
| 14 | 2,6-dimethyl benzyl | Na | Au/Ag | PAX | 9.9 |

TU = thiourea
MBT = mercaptobenzothiazole
DTP = dithiophosphate

I claim:

1. In a froth flotation process for beneficiating a gold, silver or platinum group ore comprising slurrying liberation-sized particles of said ore in an aqueous medium, conditioning the resultant slurry with effective amounts of a frothing agent and a collector, respectively, and floating the desired gold, silver or platinum group minerals by froth flotation methods, the improvement comprising: conducting said flotation step at a pH of above 7.0 and in the presence of a primary collector for said gold, silver or platinum group minerals consisting essentially of at least one monothiophosphate compound having the formula:

$$(RO)_2\underset{\underset{S}{\|}}{P}O^-.X^+$$

wherein each R is, individually, selected from $C_2$–$C_8$ alkyl and

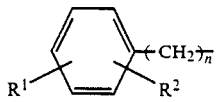

radicals wherein $R^1$ and $R^2$ are, individually, hydrogen or $C_1$–$C_4$ alkyl radicals, n is 0 or 1 and X is a cation, alone or in combination with an auxiliary collector selected from the group consisting of xanthates, dithiophosphates, dithiophosphinates, thioureas and mercaptobenzothiazoles and selectively recovering the gold, silver or platinum group metal from said froth.

2. The process of claim 1 wherein said primary collector is added in an amount of from about 0.005 to about 0.5 lb/ton or ore.

3. The process of claim 1 wherein said aqueous slurry of liberation-sized ore particles has a pH value of from 7.0 to about 12.0.

4. The process of claim 1 wherein each R is a $C_2$–$C_8$ alkyl radical.

5. The process of claim 1 wherein each R is a

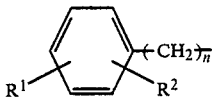

radical.

6. The process of claim 5 wherein each of $R^1$ and $R^2$ is hydrogen.

7. The process of claim 5 wherein n is 0, $R^2$ is hydrogen and $R^1$ is methyl.

8. The process of claim 4 wherein each R is ethyl.

9. The process of claim 4 wherein each R is isobutyl.

10. A method according to claim 1 wherein the auxiliary collector is a xanthate.

11. A method according to claim 1 wherein said auxiliary collector is mercaptobenzothiazole.

* * * * *